US006971814B2

(12) United States Patent
Rosenzweig et al.

(10) Patent No.: US 6,971,814 B2
(45) Date of Patent: Dec. 6, 2005

(54) BALL TIP FOR A WRITING INSTRUMENT AND METHOD FOR MAKING SAME

(75) Inventors: Alain Rosenzweig, Saint Maur des Fosses (FR); Kurt Rath, Asnieres sur Seine (FR); André Dehaudt, Gagny (FR)

(73) Assignee: Societe Bic, Cedex (FR)

( * ) Notice: Subject to any disclaimer, the term of this patent is extended or adjusted under 35 U.S.C. 154(b) by 0 days.

(21) Appl. No.: 11/026,116

(22) Filed: Dec. 30, 2004

(65) Prior Publication Data

US 2005/0117961 A1 Jun. 2, 2005

Related U.S. Application Data

(63) Continuation of application No. PCT/FR03/01618, filed on May 28, 2003.

(30) Foreign Application Priority Data

Jul. 1, 2002 (FR) ..... 02 08189

(51) Int. Cl.[7] ..... B43K 7/10
(52) U.S. Cl. ..... 401/216; 401/209
(58) Field of Search ..... 401/208, 209, 401/212, 214, 216

(56) References Cited

U.S. PATENT DOCUMENTS

| | | | | |
|---|---|---|---|---|
| 2,573,691 A | | 11/1951 | Chester | |
| 3,000,090 A | | 9/1961 | Fehling | |
| 3,380,152 A | * | 4/1968 | Wilcox | 29/441.2 |
| 3,605,246 A | | 9/1971 | Regnault | |
| 6,082,920 A | * | 7/2000 | Furukawa | 401/216 |

FOREIGN PATENT DOCUMENTS

| | | |
|---|---|---|
| FR | 1201888 | 8/1958 |
| FR | 1576412 | 6/1969 |
| FR | 2368372 | 5/1978 |
| GB | 624366 | 7/1946 |
| WO | WO 00/69653 | 11/2000 |

* cited by examiner

*Primary Examiner*—David J. Walczak
(74) *Attorney, Agent, or Firm*—Jones Day

(57) ABSTRACT

The ball point comprises a body having a front surface and a housing emerging in an opening in the front surface and communicating with a passage supplying a fluid. A ball can rotate freely in the housing. The body front surface has a peripheral portion parallel to the median plane of the opening and a flared portion adjacent to the opening periphery which forms at the point of contact of the ball with the opening periphery an acute angle (alpha) with the emerging part of the plane tangent to the ball at the contact point.

14 Claims, 1 Drawing Sheet

BALL TIP FOR A WRITING INSTRUMENT AND METHOD FOR MAKING SAME

CROSS REFERENCE TO RELATED APPLICATION

The present application is a continuation of U.S. National Stage designation of co-pending International Patent application PCT/FR03/01618, filed on May 28, 2003, which claims priority to French Patent application 02 08189, filed Jul. 1, 2002. The entire contents of both these application is expressly incorporated herein by reference thereto.

FIELD OF THE INVENTION

The present invention relates to a ball tip for a writing instrument. More particularly, the present invention relates to a tip body having a front face; a housing terminating in an opening in the front face and communicating with a fluid supply passage; and a ball freely rotatably mounted in the housing and emerging from the opening.

BACKGROUND OF THE INVENTION

The ball tips of the aforementioned type are used for writing instruments of the ballpoint pen type, but also for writing instruments used for depositing a line of correction fluid or adhesive onto the paper. However, during their use the fluid accumulates on the front face and sometimes even on the lateral face of the tip body and this may result in dirty marks.

In the specific case of ballpoint pens, the ink accumulated on the tip may also become deposited on the paper in the course of the writing movement, leading to a smudge being left on the paper. In order to prevent this problem encountered with ballpoint pens, it has been proposed to modify the mechanical characteristics of the ink, especially its fluidity. However, modifying the ink generally has a damaging effect on the writing sensation perceived by the user and on the quality of the inscription on the paper.

In the case of writing instruments of the correction fluid or adhesive applicator type, it is very difficult to modify the characteristics of the fluid. Moreover, drying of the accumulation of such fluids may cause the ball to become blocked and to make the writing instrument unusable.

SUMMARY OF THE INVENTION

The aim of the present invention is to overcome the disadvantages mentioned above by proposing a ball tip which is perfectly clean to use without diminishing the gliding sensation of the tip on the paper or requiring an ink of specific composition if a ballpoint pen is involved. In the case of writing instruments of the correction fluid or adhesive applicator type, an additional aim of the invention is to prevent the ball from being blocked after a prolonged period of not being used.

To this end, the subject of the invention is a ball tip of the aforementioned type in which the front face of the tip body has a peripheral portion substantially parallel to the average plane of the opening and a flared portion adjacent to the perimeter of the opening, which forms, at the point of contact of the ball with the perimeter of the opening, an acute angle of less than 70 degrees with the emergent part of the plane tangent to the ball at said point of contact.

The combination of the peripheral portion and the flared portion makes it possible for smudges and ink accumulation on the tip to be reduced to a completely unexpected extent. In fact, tests carried out with ballpoint pens provided with a tip according to the invention no longer display any smudging even when using a greasy ink which advantageously provides a good gliding sensation of the tip. In the case of instruments of the correction fluid or adhesive applicator type, the risk of the ball blocking is greatly reduced.

This result is all the more surprising as it has long been sought to prevent the formation of a flared portion having an acute angle with the tip.

In fact, the first ballpoint pen tips produced industrially, such as those described in document GB-A-624366 (corresponding to U.S. Pat. No. 2,573,691 to Chesler), had a front face of flared shape resulting from the ball being crimped by a rolling operation on the tip body, in the course of which operation the metal situated at the periphery of the tip body was pushed forward to a greater degree than the metal adjacent to the ball. However, the major defect of these first ball tips was that they caused a large number of smudges.

Subsequently, it was found that the phenomenon of smudging was reduced using a front face forming, at the point of contact with the ball, a right angle, and preferably even an obtuse angle, with the emergent part of the plane tangent to the ball. It has ever since been sought, when crimping the ball, to prevent the formation of a flared portion having an acute angle.

In preferred embodiments of the invention, recourse has additionally been had to one and/or other of the arrangements below:

the angle formed by the flared portion and the emergent part of the plane tangent to the ball at the contact point with the perimeter of the opening is between 30 and 70 degrees, preferably substantially equal to 45 degrees;

the flared portion has an axial height h, measured in a direction perpendicular to the average plane of the opening, of between 0.6% and 5% of the diameter of the ball;

the peripheral portion has a width l, measured in a radial direction of the opening, of at least 0.01 millimeter and preferably between 1.2% and 5% of the diameter of the ball;

the axial height h of the flared portion is substantially equal to the width l of the peripheral portion;

the opening in the tip body has symmetry of revolution about a central axis;

the flared portion is formed by a frustoconical surface coaxial with the central axis of the opening;

the tip body is made of metal, and the ball is retained in the housing by crimping the tip body.

Moreover, another subject of the invention is:

a ballpoint pen comprising a ball tip as defined above, in which the diameter of the ball is between 0.5 and 1.6 millimeters, and the ink has a viscosity of greater than 40 poises; and also a method of manufacturing such a ball tip from a blank tip body having a front face and including a housing of which a cylindrical front part terminates in an opening made in said front face, in which:

a flared portion is made by chamfering the perimeter of the opening;

a ball having a diameter substantially equal to the diameter of the cylindrical front part of the housing is inserted through the opening;

the tip body has a front end which is crimped against the ball so as to retain the latter in the housing.

BRIEF DESCRIPTION OF THE DRAWINGS

Other features and advantages of the invention will become apparent in the course of the description which will follow, given by way of nonlimiting example, with reference to the appended drawings, in which.

DETAILED DESCRIPTION OF THE DRAWINGS

The same references have been retained in the various figures to designate identical or similar elements.

Figure 2:
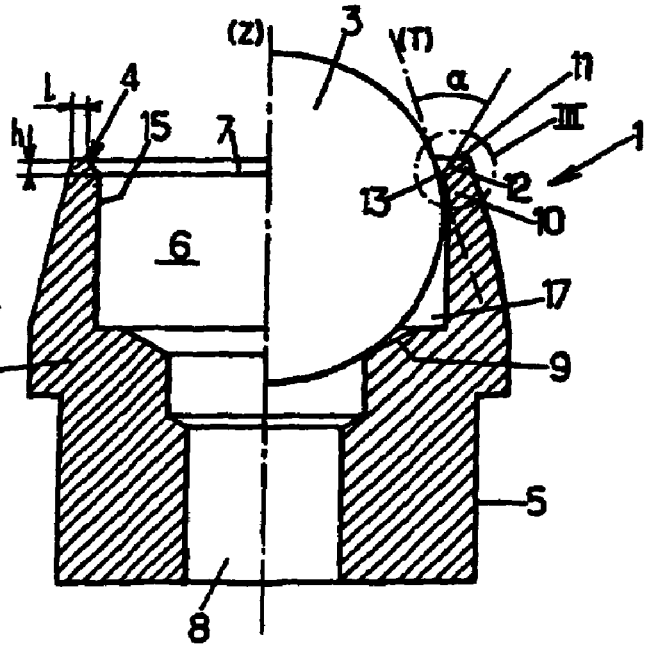
FIG. 2 is a simplified longitudinal sectional view of a ball tip according to principles of the present invention.

FIG. 2 depicts a ball tip 1 for a writing instrument, more specifically for a ballpoint pen, comprising a tip body 2.

The half-view on the left of FIG. 2 represents a blank tip body while the half-view on the right represents the tip body after fitting a ball 3. The tip body 2 has a front face 4 and a shoulder 5 on which an ink reservoir (not shown) can be fixed.

The tip body 2 includes a housing 6 which terminates in an opening 7 made in the front face 4.

In the embodiment represented, the housing 6 is substantially cylindrical and the opening 7 has symmetry of revolution about a central axis Z which coincides with the axis of symmetry of the tip body.

A fluid supply passage 8 provides communication between the ink reservoir and the housing 6.

The ball 3 is mounted free to rotate in the housing 6 and emerges through the opening 7.

In the embodiment represented, the ball 3 is retained by a seat 9 formed at the bottom of the housing 6 and by the front end 10 of the wall of the tip body 2, which matches the contour of the ball. The tip body 2 is made of metal in the embodiment represented, which allows matching with the ball 3 by a crimping operation on the front end 10.

Thus, the ball is unable to make any translational movement in the housing 6. However, the invention is also applicable to ball tips comprising a spring, arranged along the central axis Z, which biases the ball against the front end 10 of the tip body.

The seat 9 may comprise ducts or fins which promote ink flow from the supply passage 8 to the space 17, situated between the ball and the seat, so that the ink is uniformly deposited on the ball.

According to the invention, the front face 4 of the tip body has a peripheral portion 11 and, around the perimeter of the opening 7, a flared portion 12.

The peripheral portion 11 extends toward the central axis Z from the outer perimeter of the front face 4 to the flared portion 12. The peripheral portion 11 is substantially parallel to the average plane of the opening 7, that is to say, in the embodiment represented, substantially perpendicular to the central axis Z.

The flared portion is arranged so as to form, at the point of contact 13 of the ball 3 with the perimeter of the opening 7, an acute angle $\alpha$ with the emergent part of the plane tangent to the ball at said point of contact 13, the outline T of this plane being visible in FIG. 2.

The combination of the peripheral portion 11 and the flared portion 12 makes it possible to reduce in a very considerable manner the accumulation of ink on the front face 4 and the appearance of smudges on the paper.

In fact, tests show that with the ball tip having a flared portion according to the invention, there is no longer any smudging and this is the case even when using an ink not containing any additives intended to limit the appearance of smudges. It is therefore possible to use a traditional greasy ink whose viscosity greater than 40 poises. Furthermore, the other characteristics of the tip, such as ease of writing, for example, are not impaired.

Figure 3:
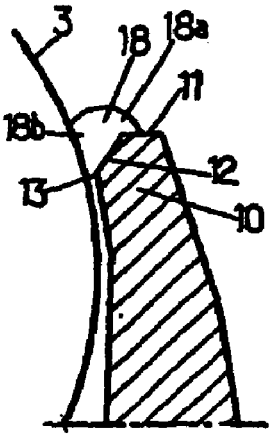
FIG. 3 represents an enlarged view of the portion III in FIG. 2.

The inventors filmed the ball 3 rolling on a paper-type surface under high magnification. The films show a progressive accumulation of the ink at a point of contact 13 between the ball and the front face 4, this point of contact being situated in an opposed manner to the direction of rolling. The accumulation of ink ends up forming a drop 18, as represented schematically in FIG. 3.

However, this drop does not extend beyond the peripheral portion 11 and, consequently, no ink is deposited on the radially outer face of the tip body 2. It will also be noted that the drop does not detach from the front face 4 on reversal of the direction of rotation of the ball, which explains the disappearance of the smudges. It is assumed that these phenomena are obtained as a result of a slight drying of the portion 18*a* of the drop, which is situated to the outside and therefore in contact with air.

Furthermore, when the drop reaches a certain size, it collapses in on itself and virtually disappears from the front face 4. This phenomenon may be explained by the presence of the flared portion 12, which forms with the wall of the ball 3 a funnel facilitating the return of the ink accumulated during the rotation of the ball. The portion 18*b* of the drop in contact with the ball 3 remains fluid owing to the supply of fresh ink. The fluidity of the portion 18*b* undoubtedly allows ink return to be initiated.

Figure 1:
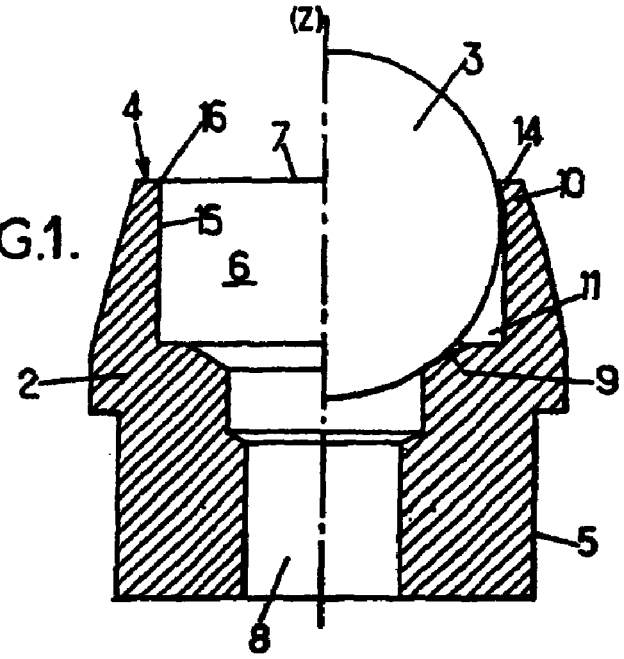
FIG.1. PRIOR ART
FIG. 1 is a simplified longitudinal sectional view of a prior art ball tip.

The ball tip according to the invention thus makes it possible to confine an accumulation of ink and then return it into the tip body, this being in contrast to the ball tips of the prior art, such as that represented in the half-view on the right of FIG. 1.

The opening 7 in these prior art ball tips has a perimeter 14 which forms an obtuse angle with the wall of the ball 3, which rather has the effect of scraping off the ink present on the ball as it rotates and of retaining the accumulation of ink formed on the front face 4. Such an accumulation of ink can then be deposited on the paper, especially when the direction of rotation of the ball is changed, and create a smudge.

Preferably, the flared portion 12 is formed by a frustoconical surface coaxial with the central axis Z of the opening 7. This particular form of the flared portion has the advantage of being able to be produced with high precision, particularly with the manufacturing method described hereinbelow.

The angle $\alpha$ formed between the flared portion 12 and the emergent part of the tangent plane T is about 45° in the embodiment represented, but the flared portion 12 maintains its function with an angle $\alpha$ varying between 30° and 70°.

Tests show that with a ball of large diameter, for example 1.6 millimeters, it is sufficient for the axial height h of the frustoconical surface 12 to be between 0.01 and 0.08 millimeter to prevent the appearance of smudges. However, the diameter of the ball may be smaller, down to 0.5 millimeter, or greater. The axial height h may then be modified proportionately so that it is between 0.6% and 5% of the diameter of the ball.

The peripheral portion 11 has the form of a circular ring on account of the symmetry of revolution about the central axis Z of the tip body 2. This ring is flat prior to the production of the flared portion 12 by machining and the crimping of the ball 3, but it may be slightly deformed during these operations and, consequently, the peripheral portion 11 may be only substantially planar when the ball tip is completed.

The peripheral portion 11 has a width l measured in a radial direction of the opening 7, that is to say along a perpendicular to the central axis Z. The width l must be sufficient to retain a drop of ink 18 without the latter reaching the outer perimeter of the front face 4 and running onto the radially outer wall of the tip body 2.

With a ball having a diameter of 1.6 millimeters and a greasy ink, tests show that the width l may be between 0.02 millimeter and 0.08 millimeter, that is to say between 1.2% and 5% of the diameter of the ball. A larger width of the peripheral portion 11 is of course conceivable, but it would increase the overall size of the tip body 2. In the case of a ball of different diameter, the width l may be modified proportionately so that it is between 1.2% and 5% of the diameter of the ball. However, it is preferable for the width l to be at least 0.01 millimeter in order to retain an accumulation of ink.

In the embodiment represented, the axial height h of the flared portion 12 is substantially equal to the width l of the peripheral portion 11, which provides a good compromise between ball tip cleanliness and the outside diameter of the front face 4.

The ball tip according to the invention may be manufactured from a blank tip body identical to those used for manufacturing the ball tips of the prior art and represented in the half-view on the left side of FIG. 1. The housing 6 of this blank tip body has a cylindrical front part 15 which terminates in an opening 7, forming a right angle 16 with the front face 4 of the tip body 2.

To produce the flared portion 12, the perimeter of the opening 7 is chamfered so as to remove the right angle 16, then the ball 3 is inserted into the housing 6 through the opening 7.

The diameter of the ball 3 is more or less equal to the diameter of the cylindrical part 15 of the housing 6 depending on whether it is desired to obtain an insertion by force or with slight friction and a greater or lesser space between the ball and the wall of the housing.

Next, the front end 10 of the tip body 2 is crimped against the ball so as to retain the latter in the housing 6. As a result of the crimping operation, the inner wall of the front end 10 matches the wall of the ball, leaving a defined space between these two walls.

This manufacturing method has the advantage of being able to use the blank tip bodies of the prior art and requires only one additional step, namely the chamfering step, the other manufacturing steps being unchanged. Thus, the ball tip according to the invention may be mass produced without profoundly modifying the production tool.

Of course, this embodiment describing a ball tip more specifically intended for a ballpoint pen is in no way restrictive. The dimensions of the peripheral portion and of the flared portion may be adapted to suit the diameter of the ball or the thickness of the film present on the emergent part of the ball, especially in the case of a ball tip for a correction fluid or adhesive applicator in which the diameter of the ball may reach 3 millimeters.

What is claimed is:

1. A ball tip for a writing instrument, said ball tip comprising:

a tip body having a front face, said tip body including a housing which terminates in an opening made in said front face and communicating with a fluid supply passage; and a ball mounted free to rotate in said housing and emerging from said opening;

wherein:

said front face of said tip body has a peripheral portion substantially parallel to the average plane of said opening and a flared portion adjacent to the perimeter of said opening, said flared portion forming, at the point of contact of said ball with the perimeter of said opening, an acute angle of less than 70 degrees with the emergent part of a plane tangent to said ball at said point of contact, and wherein said flared portion is formed by a frustoconical surface coaxial with the central axis of said opening.

2. The ball tip as claimed in claim 1, wherein said angle formed by said flared portion and said emergent part of the plane tangent to said ball at said contact point with said perimeter of said opening is between 30 and 70 degrees.

3. The ball tip as claimed in claim 1, wherein said angle is substantially equal to 45 degrees.

4. The ball tip as claimed in claim 1, wherein said flared portion has an axial height measured in a direction perpendicular to the average plane of said opening, of between 0.6% and 5% of the diameter of said ball.

5. The ball tip as claimed in claim 4, wherein said peripheral portion has a width, measured in a radial direction of said opening, of at least 0.01 millimeter.

6. The ball tip as claimed in claim 5, wherein said width is between 1.2% and 5% of the diameter of said ball.

7. The ball tip as claimed in claim 6, wherein said axial height of said flared portion is substantially equal to said width of said peripheral portion.

8. The ball tip as claimed in claim 5, wherein said axial height of said flared portion is substantially equal to said width of said peripheral portion.

9. The ball tip as claimed in claim 1, wherein said peripheral portion has a width, measured in a radial direction of said opening, of at least 0.01 millimeter.

10. The ball tip as claimed in claim 9, wherein said opening in said tip body has symmetry of revolution about a central axis.

11. The ball tip as claimed in claim 10, wherein said tip body is made of metal and said ball is retained in the housing by crimping said tip body.

12. The ball tip as claimed in claim 1, wherein said tip body is made of metal and said ball is retained in the housing by crimping said tip body.

13. A ballpoint pen comprising a ball tip as claimed in claim 1, wherein the diameter of said ball is between 0.5 and 1.6 millimeters, and ink has a viscosity of greater than 40 poises.

14. A method of manufacturing a ball tip for a writing instrument, from a blank tip body having a front face and including a housing of which a cylindrical front part terminates in an opening made in said front face and which communicates with a fluid passage, said method comprising:

a chamfering of the perimeter of the opening to create a flared portion and to leave a peripheral portion in said front face, which is substantially parallel to the average plane of said opening;

inserting a ball having a diameter substantially equal to the diameter of the cylindrical front part of the housing through the opening; and crimping the front end of the tip body against the ball to retain the ball in the housing, said ball being mounted free to rotate in said housing and emerging from said opening;

wherein:

said flared portion forms, at the point of contact of said ball with the perimeter of said opening, an acute angle of less than 70 degrees with the emergent part of a plane tangent to said ball at said point of contact.

* * * * *